US005782026A

United States Patent [19]

Capie

[11] Patent Number: 5,782,026

[45] Date of Patent: Jul. 21, 1998

[54] BACK LIT MULTI IMAGE TRANSPARENCY

[76] Inventor: John Capie, 7050 Village Dr., Suite F, Buena Park, Calif. 90621

[21] Appl. No.: 349,419

[22] Filed: Dec. 5, 1994

[51] Int. Cl.[6] ..... G09F 19/14

[52] U.S. Cl. ..... 40/453; 156/58

[58] Field of Search ..... 40/453, 454; 434/97, 434/365; 156/58

[56] References Cited

U.S. PATENT DOCUMENTS

| | | | |
|---|---|---|---|
| 4,481,050 | 11/1984 | Gundlach et al. | 156/58 |
| 4,766,684 | 8/1988 | Wah Lo et al. | 40/454 |
| 4,959,641 | 9/1990 | Bass et al. | 40/454 X |
| 5,035,929 | 7/1991 | Myers et al. | 40/454 X |

*Primary Examiner*—Brian K. Green
*Attorney, Agent, or Firm*—Stetina Brunda Garred & Brucker

[57] ABSTRACT

A number of non specific, preexisting images are combined using an optical process of masking that (for purposes of clarity the following assumes 3 images are used) removes ⅔ of the first image in a sequential/lenticular pattern, replacing the removed image segments with ⅓ of each of the other two images also sequentially. These combined images are then separated by thin black separation lines using a special burning mask. This series of images and black lines is then visually decombined through the use of a clear thickness of material sandwiched together with the combined transparency and, using a non opaque adhesive, to a decombining mask in registration. This product is then able to be trimmed down and inserted into any preexisting light box. The product when back lit and viewed from the front creates the illusion of 3 complete, separate and sequential, non ghosting images that appear separately depending upon the viewers angle in relationship to the horizontal plane of the standing image.

4 Claims, 1 Drawing Sheet

BACK LIT MULTI IMAGE TRANSPARENCY

BACKGROUND OF INVENTION

1. Field of the Invention

The present Invention relates to the manufacturing process for creating back lit images for use in light box displays. More specifically, the present invention relates to an improved process for manufacturing single transparencies that when displayed, contain more than one image when viewed from different angles.

2. Prior Art

To maximize the usefulness and effectiveness of a back lit display to inform and entertain a viewer has been a goal for most advertisers. Many striking visual designs have been created to this end. The shortcoming is always the lack of motion. To this end many mechanical boxes have been designed to change the image creating motion during transition. But this does not create a solution for those who have pre-existing and installed back lit displays. No process to date has satisfactorily solved this problem.

SUMMARY OF INVENTION

The principal object of the present invention is to provide a single transparency that can be placed in an existing back lit display and contain more than 1 image. The invention is an improved process for embedding more than one object in a single back lit type transparency that, when viewed from various angles, shows a distinct and separate non ghosting image.

Additionally, the image dissolve is fast and crisp creating the illusion of motion without use of any outside additional mechanical or external device other than the viewer.

The forgoing can be accomplished using specific patterns of masking and viewing screens that when sandwiched into a single transparency, can produce crisp single images that change depending upon the viewers angle to the front plane of the display.

As the viewer moves horizontally past the display the image shown changes completely or in part depending upon design through the use of a lenticular viewing mask. The improvement in production is a combination of refinements. It is through these various improvments and the addition of black separation bars and image optimization that allows for color saturation even though a percentage of the individual image is lost in process.

DETAILED DESCRIPTION

Figure 1:
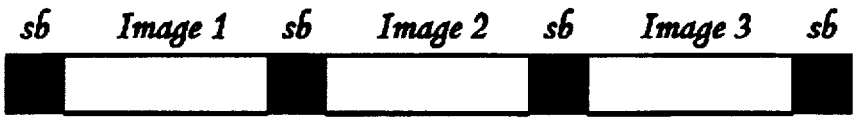
FIG. 1 is an enlarged cross-sectional side view of the photographic transparency showing the positions of three images thereon and also showing the separation bars therebetween.

FIG. 1 of the drawings shows an enlargement of the image plane depicting how the various images are laid down. More particularly, it shows how three images are first combined using an optical process of masking that removes ⅔ of the first image (i1) in a sequential/lenticular pattern, replacing the removed image segments with ⅓ of each of the other two images (i2+i3) sequentially.

Figure 2:
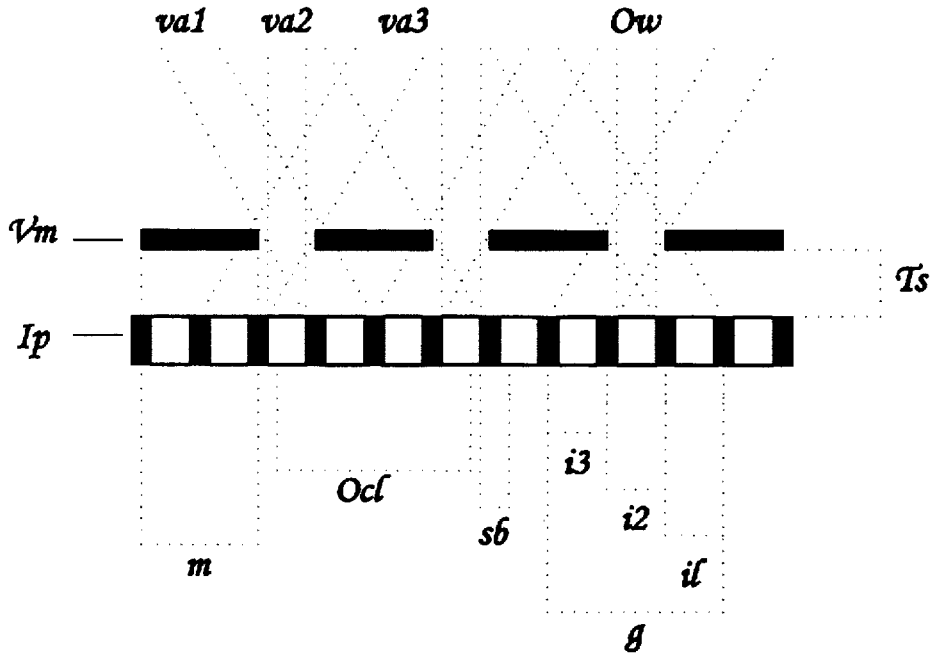
FIG. 2 is a cross-sectional side view of a portion of the back lit multi image transparency of the present invention showing the photographic transparency of FIG. 1 attached to one side of a transparent substrate and also showing a viewing mask attached to the other side of the transparent substrate.

FIG. 2 of the drawing shows how this combined image is then visually decombined through the use of a decombining mask to create the illusion of three complete, separate and sequential, non-ghosting images.

The drawings show specifically the various components, spacing and relationships of the process for producing a multiple image single transparency.

The elements are defined as:

va1 (Viewing angel 1) Components all combine visually to create Image 1, when viewed through the decombining mask at the left angle.

va2 (Viewing angel 2) Components all combine visually to create Image 2, when viewed through the decombining mask at the center angle.

va3 (Viewing angel 3) Components all combine visually to create Image 3, when viewed through the decombining mask at the right angle.

g=Grouping of image components. g=i1+i2+i3. Sequence: repeats iX=Component defined by position. Each component represents ⅓ of original image.

Ow=Opening width; Ow=ix, ix=⅓ of g, g=i1+i2+i3.

sb=Separation bars. Produces a non ghosting smooth transition. Results in a 5% loss to each image it separates.

Ocl=On center line alignment of spacing of Ow. Ocl=g. Sequence: (m+Ow+m+Ow . . . )

m=Mask component width, m=ix+ix. m=⅔ of g. Sequence: (m+Ow+m+Ow . . . )

Vm=Viewing Mask, also refereed to as the decombining mask or element.

Ip=Image plane. Combined images on single film plane.

It is important to notice that this example defines the workings of a 3 image combining/decombining process. (For simplification of explanation and drawing description, a three image example is being used. However the variations of this process can produce any number of image variations from 2 to more than 15.)

It is through the use of a pin registered vacuum chamber and 4 exposure masks, 3 individual images are combined through a masking and exposure process (photographic optical process maximizing the inherent individual image) that results in a combined image (Ip) incorporating elements from each original plus separation bars (sb). To produce this image you must follow the following sequence and specifications:

A. Using a sequence of 1,2,3,1,2,3,etc and sizing of 10 mil.

B. Mask "a" is open at position 1 and closed at positions 2 and 3

C. Mask "b" is open at position 2 and closed at positions 1 and 3

D. Mask "c" is open at position 3 and closed at positions 1 and 2

E. Mask "d" conforms to a spacing of closed for 9 mil and open for 1 mil.

F. Mask "d" is positioned so as to align the centerpoint of its open section with the abutting edges of "a"–"b", "b"–"c", and "c"–"a".

G. All positions are parallel and vertical.

H. Pin registration is maintained for all maskS.

I. Vacuum is required for all exposures.

J. Exposures are with Pins at left edge, masks emulsion down, and image right reading.

K. All negatives optimized for back-lit display

Multiple Image Displays

The combined image transparency is back mounted to a clear thickness of translucent plastic substrate (Ts) in registration (open area (Ow) to image position 2 (i2)) with a face mounted decombining viewing mask (Vm). This sandwiching of materials is mounted under high pressure, trimmed to size and placed viewing mask (Vm) out in any standard light box. The final product consists of:

A. Viewing Mask

B. Adhesive

C. Clear translucent plastic substrate Spacer

D. Adhesive

E. Composed Image Plane

Requirements to Complete Process

A. Image Plane and Viewing Mask are mounted in register to the back and front of the B. translucent plastic substrate respectively.

C. translucent plastic substrate is of variable thickness dependent upon desired transition speed.

D. Viewing masks maintain a 10 mil open position followed by 20 mil closed position sequence—Typ.

E. Viewing mask register should align open positions with the #2 positions of the Image Plane.

F. All positions on viewing masks are parallel and vertical.

I claim:

1. A method for forming a back lit multi image transparency, the method comprising the steps of:

a) combining multiple images onto a single photographic transparency by providing at least one mask representative of each image and sequentially pin registering each mask along with the transparency in a vacuum chamber, applying a vacuum, and forming the image of each mask onto the transparency;

b) attaching the photographic transparency to a first side of a non-opaque substrate;

c) forming a viewing mask which is configured to facilitate viewing substantially of only one of the multiple images at each of various different view angles; and d) attaching the viewing mask to a second side of the non-opaque substrate.

2. The method as recited in claim 1 wherein the steps of attaching the photographic transparency and the viewing mask to the non-opaque substrate comprise attaching the photographic transparency and the viewing mask to a translucent substrate.

3. The method as recited in claim 1 wherein the steps of attaching the photographic transparency and the viewing mask to the non-opaque substrate comprise attaching the photographic transparency and the viewing mask to a translucent plastic substrate.

4. The method as recited in claim 1 wherein the steps of attaching the photographic transparency and the viewing mask to the non-opaque substrate comprise attaching the photographic transparency and the viewing mask to the non-opaque substrate via non-opaque adhesive.

* * * * *